United States Patent [19]

Adams

[11] Patent Number: 4,480,386

[45] Date of Patent: Nov. 6, 1984

[54] PROCESS FOR PRODUCING DUAL BEAM ELECTRICAL CONTACT

[75] Inventor: John E. Adams, Mechanicsburg, Pa.

[73] Assignee: E. I. Du Pont de Nemours and Company, Wilmington, Del.

[21] Appl. No.: 396,277

[22] Filed: Jul. 8, 1982

[51] Int. Cl.[3] ..... H01R 43/00

[52] U.S. Cl. ..... 29/874; 339/276 T

[58] Field of Search ..... 29/874, 873, 866; 339/276 T, 97 R; 10/152 R

[56] References Cited

U.S. PATENT DOCUMENTS

| | | | |
|---|---|---|---|
| 2,694,189 | 11/1954 | Wirsching | 339/97 R |
| 2,727,299 | 12/1955 | Klumpp, Jr. | 339/276 T |
| 3,273,108 | 9/1966 | Radocy | 29/874 X |
| 3,420,087 | 1/1969 | Hatfield et al. | 29/874 X |
| 3,654,594 | 4/1972 | Sitzler | 339/276 T X |
| 4,018,177 | 4/1977 | McKee et al. | 29/874 |

*Primary Examiner*—Mark Rosenbaum
*Assistant Examiner*—Carl J. Arbes

[57] ABSTRACT

Stamping out a dual beam contact with preload tabs from flat sheet metal stock by first blanking out beams having a 10° angle with respect to the centerline. The preload tabs are separately blanked with their ends adjacent to the ends of the beams. During the subsequent forming operation the tabs are bent 45° in a direction away from the beams, the ends of the beams are curled away from the tabs and the beams are bent upward at a 90° angle to form a U with the centerline.

6 Claims, 7 Drawing Figures

PROCESS FOR PRODUCING DUAL BEAM ELECTRICAL CONTACT

DESCRIPTION

A. TECHNICAL FIELD

This invention relates to electrical connectors. More particularly, it refers to a process for stamping elongate dual beam electrical contacts from flat metal stock.

B. BACKGROUND ART

Dual beam female electrical contacts are widely used to mate with contacts on circuit boards and to pin connectors. Preloading the beams for the purpose of reducing insertion forces is a desirable feature incorporated into the design of many of these dual beam contacts. For example, see U.S. Pat. No. 4,327,956.

Unfortunately, the known process for stamping dual beam contacts with preload tabs requires the use of large quantities of additional flat metal stock to accommodate both the beams and the preload tabs. Wastage of metal stock in this process increases the cost of the dual beam contacts. A further problem with the prior art process involves the fact that to achieve the preload condition, the beams and preload tabs are blanked together in the same cross sectional area of the flat sheet metal. The metal strip is then lanced apart with the longer section becoming the beam area and the shorter section the preload tab area. The beams and tabs are then formed. This creates an opening between each beam end and corresponding tab. To eliminate this opening the spine of the contact is indented to bring the tabs into interference fit with the beams and create the necessary preload condition. This step shortens the overall length of the contact. An improved process for reducing wastage and decreasing the cost of producing these dual beam contacts is needed.

SUMMARY OF THE INVENTION

I have discovered a new method of stamping out from flat metal strip stock a dual beam contact with preload tabs. This process requires a minimum of metal wastage and eliminates the need to shorten the contact length with an indentation in the spine. The resulting contact is produced with a significantly reduced cost.

My process produces an electrical contact having two opposing contact beams extending from one end of the contact member and two preload tabs attached to the other end of the contact member extending in the opposite direction from the contact beams. The tabs prevent the two contact beams from coming together.

This contact member is made by first stamping out pilot holes to guide the metal strip stock for precise blanking out of the contact. The beams are stamped out at a 10° angle with respect to the spine or centerline of the contact. The tabs are blanked separately with the ends of the beams adjacent to the tabs. The ends of the beams and tabs are then swaged. The forming operation then begins. The tabs are bent up at a 45° angle and the ends of the beams are curled in an opposite direction from the tabs. The beams are then bent upward at a 10° angle and then at a 20° angle. The preload tab end is then formed into a box and the contact beams are formed 90° upward on opposite 10° angles from the spine to complete the contact.

BRIEF DESCRIPTION OF THE DRAWINGS

The present invention may be best understood by those having ordinary skill in the art by reference to the following detailed description when considered in conjunction with the accompanying drawings in which.

DETAILED DESCRIPTION OF THE PREFERRED EMBODIMENT

Flat metal strip stock 10 of beryllium copper, bronze, cupro-nickel, phosphor-bronze or other current carrying metal is used as the starting material. It is preferred to use phosphor-bronze or beryllium-copper having a thickness of about 0.009" (0.23 mm) and width of about 0.800" (20.32 mm).

The flat metal strip stock 10 is first punched to form pilot holes 12. These holes 12 are used to guide the strip stock 10 for the further stamping operation.

Figure 1:
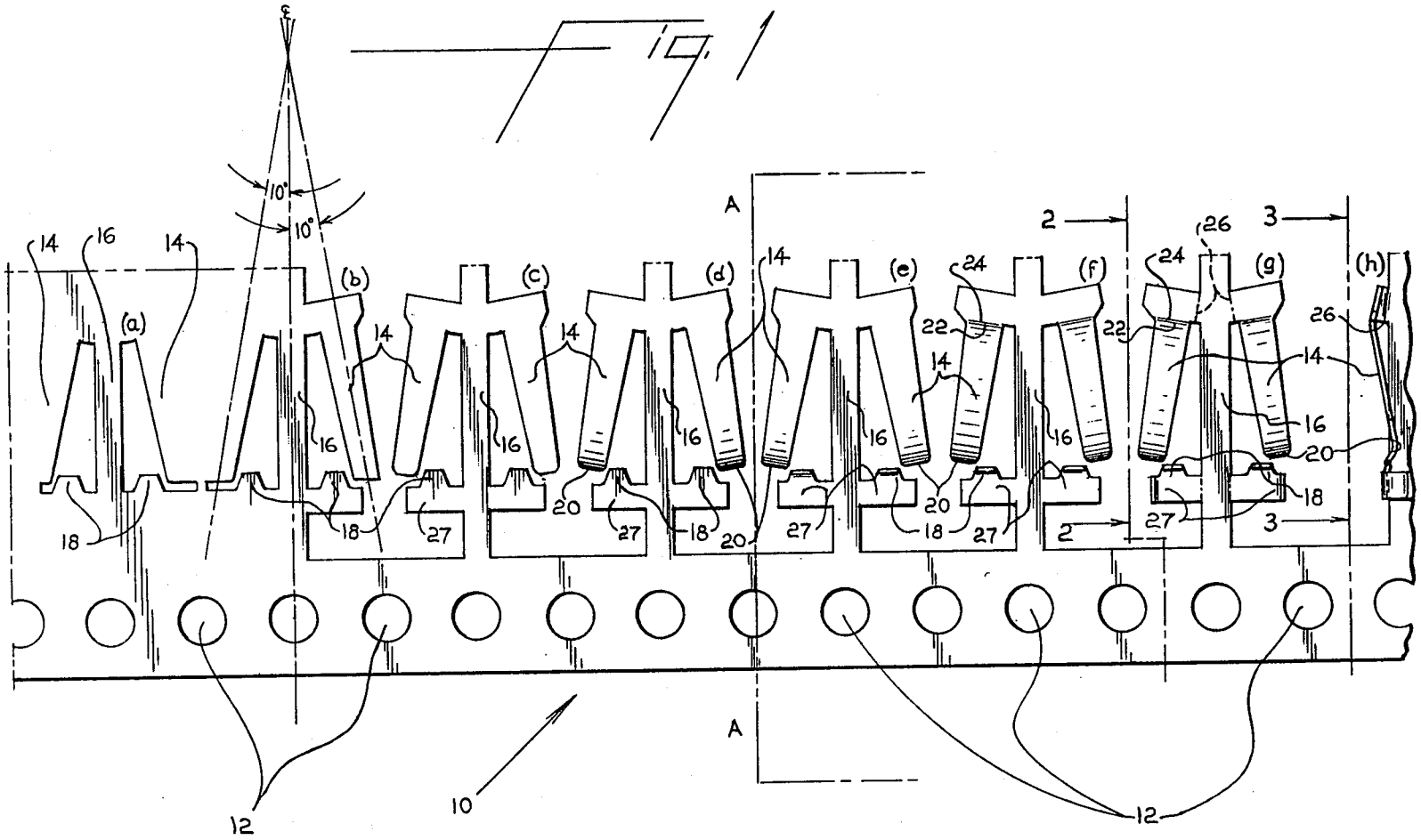
FIG. 1 (a)-(h) shows a strip metal sheet with the sequence of punching and forming steps enumerated.
Figure 2:
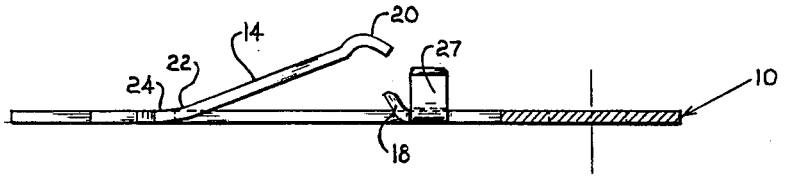
FIG. 2 shows an elevation view of a partially formed contact before the beams are turned 90°.
Figure 3:
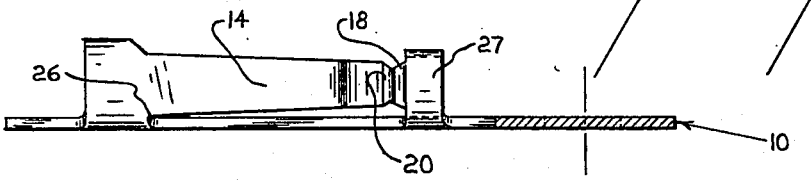
FIG. 3 shows an elevation view of a formed contact with its beam opposed by a tab.
Figure 4:
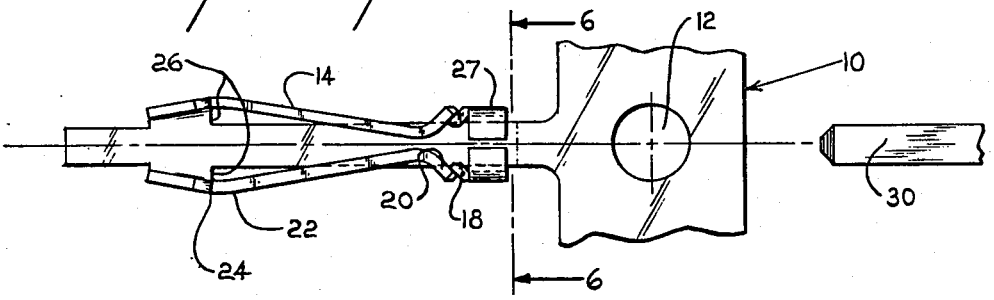
FIG. 4 is a plan view of the formed contact before removal of the carrier strip.

Referring to the left hand side of FIG. 1, a first punch (a) is made to describe the outline of the beams 14, the centerline or spine 16, and the tabs 18. Punches (b) and (c) separate adjacent contacts, define the length of the beams 14 as well as their acute angle with respect to the spine 16 and produce the pair of finger projections 27 that will be formed to create the entrance way 28 for the contact pins. It is preferred for the acute angle to be about 10°. The ends of the beams 14 and tabs 18 are also swaged during step (c).

Step (d) is a forming operation whereby a contact surface or curl 20 is made at the ends of the beams 14.

Step (e) forms the tabs 18 at a 45° angle from the flat plane to create the preload stop. This forming step places the tabs 18 in the opposite direction from curl 20.

Steps (f) and (g) are further forming operations whereby the beams are bent up from the flat plane at about 10° along line 24 and then about 20° along line 22. The distance between line 24 and line 22 is about 0.015 inches (0.381 mm) in the preferred process.

In the last step (h) the beams 14 are bent up about 90° along line 26 to form a U with the spine 16. The pin entrance way 28 is also created by forming the finger projections 27 into a box as shown in FIGS. 2–5.

Figure 5:
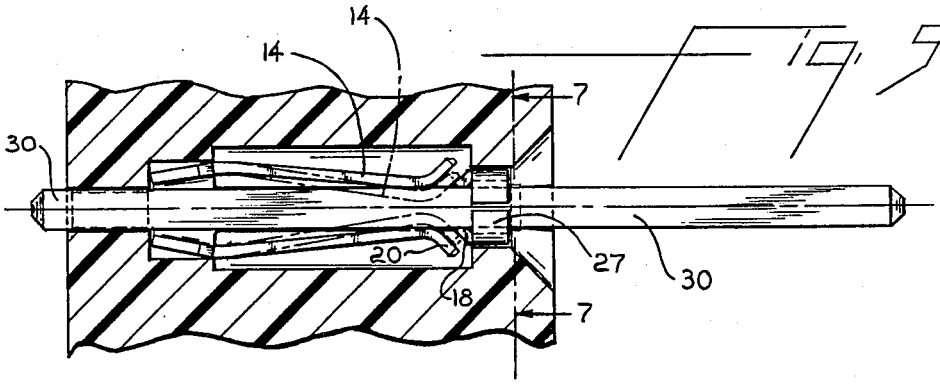
FIG. 5 is a plan view of a formed contact with a pin inserted.
Figure 6:
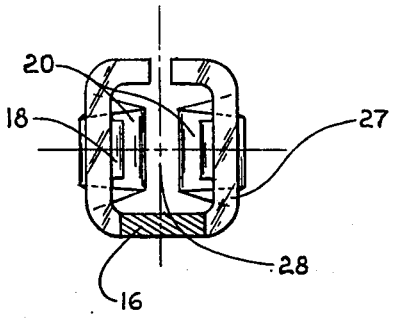
FIG. 6 is an end view of the contact before insertion of a pin.
Figure 7:
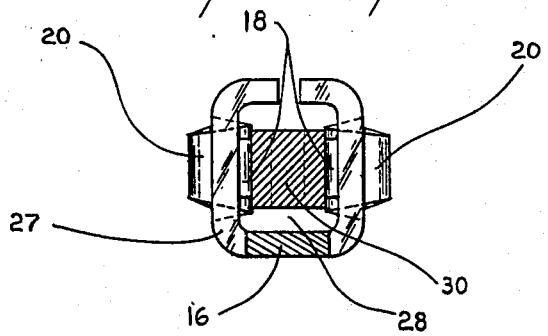
FIG. 7 is an end view of the contact with a pin inserted.

A pin 30 inserted into the pin entrance way 28 spreads the beams 14 as shown in FIGS. 5 and 7.

Having thus described the invention, what I claim and desire to be secured by Letters Patent is:

1. In a process for producing a preloaded dual beam female electrical contact from flat metal stock having prepunched pilot holes the improvement comprising (a) stamping out a pair of beams in a flat plane one beam on each side of a spine at an angle of about 10° with respect to the spine, each beam having a first and second end, the first end making the angle with the spine and the second end being adjacent to a tab in the same plane stamped out of the strip stock, each tab being parallel to the spine and located on a finger projecting from opposite sides of the spine, (b) forming a contact surface at the second end of each beam in a direction away from its corresponding tab, (c) forming the tab to create a preload stop, (d) forming the tab carrying fingers projecting from the spine into a box to provide an entrance way for a pin contact, and (e) forming the beams at their first end in a direction upward from the flat plane at acute angles and then about 90° with respect to the spine to form a U shaped body.

2. In the process according to claim 1, bending the beams upwards about 10° from the flat plane at the first end of the beam (24) and then upwards about 20° in a separate bending operation from the flat plane adjacent the first end at (22).

3. In the process according to claim 1, providing the flat metal strip stock of phosphor-bronze.

4. In the process according to claim 1, providing the flat metal strip stock of berrylium copper.

5. In the process according to claim 1, curling the contact surface at the second end of each beam in an opposite direction from the tabs.

6. The process according to claim 1 wherein the preload stop of the tab is created by bending the tab up at about a 45° angle from the flat plane.

* * * * *